United States Patent [19]

Gamarra

[11] Patent Number: 4,685,756

[45] Date of Patent: Aug. 11, 1987

[54] DROP-WIRE CLOSURE HAVING A HIGH AXIAL STRENGTH

[75] Inventor: Jose P. Gamarra, Union City, Calif.

[73] Assignee: Raychem Corporation, Menlo Park, Calif.

[21] Appl. No.: 861,673

[22] Filed: May 9, 1986

[51] Int. Cl.[4] ..... H01R 4/24

[52] U.S. Cl. ..... 439/426

[58] Field of Search ..... 339/97 R, 97 P, 98, 339/99 R

[56] References Cited

U.S. PATENT DOCUMENTS 2,359,541 10/1944 Bancroft ..... 339/97 R 2,810,115 10/1957 Abbott ..... 339/97 P 3,573,713 4/1971 Enright et al. ..... 339/98

3,835,444 9/1974 Plana et al. ..... 339/98

*Primary Examiner*—Joseph H. McGlynn

*Attorney, Agent, or Firm*—Ira D. Blecker

[57] ABSTRACT

A closure which includes a casing and an insulation displacement connector. The casing includes first and second fixed-sized passageways with an insulation placement connector disposed within each of the passageways. The connector includes a pair of spaced-apart walls each having at least one slot therein for receiving a wire. The slots in each pair of spaced-apart walls are laterally offset from one another.

11 Claims, 12 Drawing Figures

DROP-WIRE CLOSURE HAVING A HIGH AXIAL STRENGTH

BACKGROUND OF THE INVENTION

The present invention relates to a closure and more particularly to a closure for connecting telephone drop-wires.

Various connectors and closures are known in the art for connecting telephone drop-wires. Such closures and connectors generally include means for splicing conductors of the respective drop-wires. However, since often times the drop-wire is subjected to severe axial loads as can be caused by dimensional changes induced by temperature variations, high winds, heavy weight loads (e.g. ice), etc., the means for connecting and holding the drop-wires necessarily must be capable of accommodating these loads to prevent pull-out of one or both of the drop-wires from the closure or connector. Such electrical connectors and closures are generally complicated in design and expensive, and nevertheless do not guarantee a sufficient degree of reliability for withstanding axial pull-out.

In an effort to eliminate the above noted drawbacks and to provide a connector for connecting wires which is relatively simple in design and inexpensive, various closures have been suggested in U.S. patent application Ser. No. 698,644 entitled "Drop Wire Closure Having First And Second Cams", U.S. patent application Ser. No. 698,646 entitled "Drop Wire Closure Having Insulation Piercing Means", U.S. patent application Ser. No. 698,651 entitled "Drop-Wire Closure Including Cable Organizer", and U.S. patent application Ser. No. 698,652 entitled "Drop-Wire Closure Including Fixed-Sized Passageways", all of the above filed Feb. 6, 1985 and all of these disclosures being incorporated herein by reference.

While these closures are otherwise satisfactory, an improved closure is desired. Accordingly, it is an object of the invention to provide an improved closure which is simple in design and inexpensive to produce and which also provides improved axial strength.

This and other objects of the invention will become apparent after reference to the following description considered in conjunction with the accompanying drawings.

BRIEF SUMMARY OF THE INVENTION

The objects of the invention have been achieved by a closure which is elegant in its simplicity. The closure comprises a casing having first and second fixed-sized passageways with each of the passageways having an insulation displacement connector disposed therein. The connector comprises a pair of spaced-apart walls each having at least one slot therein for receiving a wire wherein the slots in each pair of spaced-apart walls are laterally offset from one another. In a preferred embodiment the closure further comprises a cover which is sized for mating with the casing.

As will become apparent hereafter the objects of the invention are achieved by use of the insulation displacement connectors which provide the closure with high axial strength to resist pull-out. Additionally the insulation displacement connectors pierce the wire insulation and provide electrical contact between the respective conductors so that a separate splice is not necessary.

DETAILED DESCRIPTION OF THE INVENTION

Figure 1:
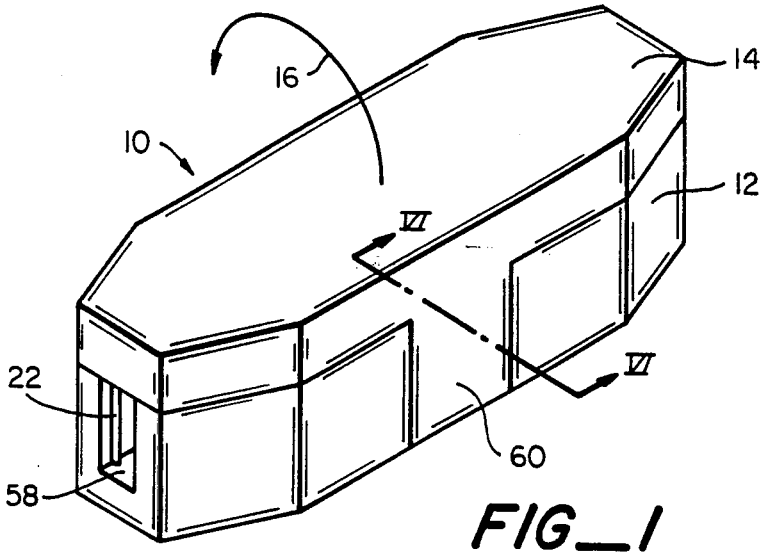
FIG. 1 is a perspective view of the assembled closure.

Referring to the figures in more detail and particularly referring to FIG. 1 there is shown an assembled closure 10 which generally comprises a casing 12 and a cover 14 which is sized for mating with the casing. While it is most preferred that the closure be used with the cover, it is not absolutely essential to certain aspects of the invention that the cover be used with the casing. When the cover is rotated in the direction of the arrow 16 shown in FIG. 1, the top of the casing is exposed as shown in FIG. 2.

Figure 2:
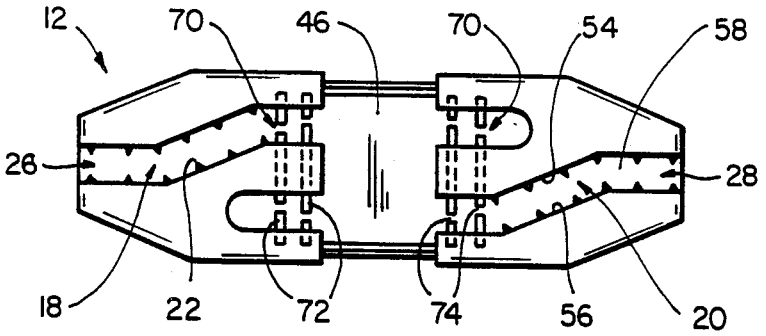
FIG. 2 is a top view of the casing with the cover of the closure rotated away from the casing in the direction of the arrow shown in FIG. 1.

Referring now to FIG. 2 there is disclosed according to the invention a closure 10 comprising a casing 12 including first 18 and second 20 fixed-sized passageways, each of the passageways having an insulation displacement connector 70 disposed therein. The connector comprises a pair of spaced-apart walls 72 each having at least one slot 74 therein for receiving a wire. The slots, as will become more apparent hereafter, are laterally offset from one another. It is preferred that there be at least two insulation displacement connectors as shown in FIG. 2. As stated just above, it is most preferred that the closure further comprise a cover which is sized for mating with the casing. As further shown in FIG. 2, inlets 26, 28 for each of the passageways are on opposite sides of the casing.

Figure 3:
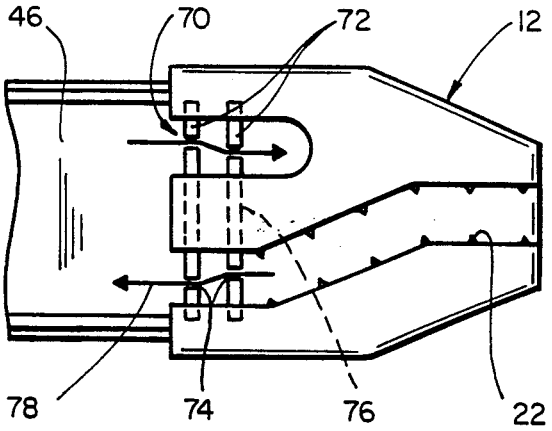
FIG. 3 is an enlarged view of the right half of FIG. 2.

Referring now to FIG. 3, there is shown in more detail the right half of FIG. 2. As can be seen, each passageway has an insulation displacement connector 70. It is most preferred that the insulation displacement connectors in adjacent passageways be connected in some manner so as to maintain electrical continuity between the connectors. The slots 74 of each connector are laterally offset from one another so that they are not longitudinally aligned. The slots will usually be offset from the middle of the passageway in opposite directions. If a wire were to be placed within the insulation displacement connector, the wire would assume a configuration as schematically indicated by arrow 78. The offset slots of the insulation displacement connectors prevent the wire from straightening, thereby producing a high frictional force which resists axial pull-out of the wire. Additionally, the offset slots enhance electrical contact between the respective conductors.

It has been found that the insulation displacement connector 70 within each of the passageways provides high axial strength for wires inserted within the passageways so as to resist pull-out of the wires. Additionally, the insulation displacement connector 70 automatically pierces the wire insulation and preferably makes electrical contact between the respective electrical conductors of the wires. Thus, stripping of the wires prior to insertion within the casing is unnecessary. All that need be done is insert the wires within the passageways of the casing and the wires become wedged in place and simulaneously electrically connected.

Each of the passageways preferably has a plurality of fixed projections or teeth 22 therein. The projections or teeth shown in FIG. 2 are viewed from the end but are actually longitudinally dimensioned as will become apparent hereafter. These projections or teeth provide additional axial strength for the closure to resist pull-out of the wires.

It is expected that the casing and cover will be made from themoplastic or thermoset molded parts. Accordingly, it is expected that the fixed projections or teeth will be molded in as well.

Figure 4:
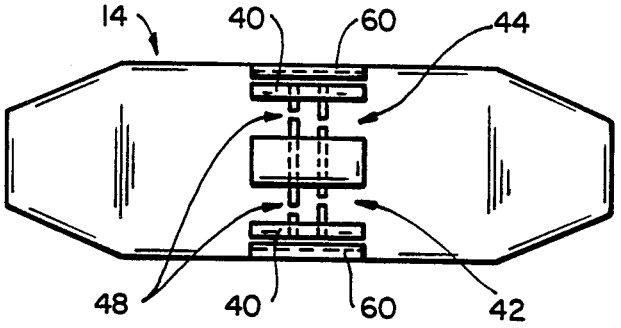
FIG. 4 is a bottom view of the cover as viewed when the cover is rotated away from the closure as shown by the arrow in FIG. 1.

Referring now to FIG. 4 there is shown the cover 14 which is sized for mating with the casing. The cover may simply have a flat surface so as to provide complete environmental protection of the wires inserted within the fixed-sized passageways of the casing. Alternatively, the cover may have an additional structure to be discussed in more detail shortly.

Figure 5:
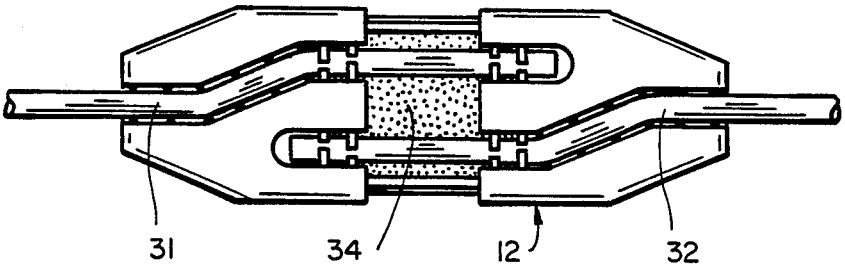
FIG. 5 is a view similar to FIG. 2 but with wires and a gel inserted therein.

In FIG. 5 there are shown wires 30, 32 inserted within each of the passageways of the casing. It can be seen that the wires are merely placed in position without their insulation being stripped therefrom. In addition an electrically insulating gel 34 can be disposed in the casing so as to environmentally isolate the electrical wires and protect them from adverse environmental elements such as water. The gel can comprise a grease but most preferably it comprises a three-dimensional molecular structure having a cone penetration between 100 and 300 ($10^{-1}$ *mm*) and an ultimate elongation of at least 200%, such structures being formable out of urethane, silicon or a non-silicon liquid rubber. Such gels are described and claimed in copending application Ser. Nos. 434,011 filed Oct. 12, 1982; 504,000 filed June 13, 1983; 507,435 filed June 23, 1983; and 656,555 filed Aug. 31, 1984, the disclosures of which are incorporated herein by reference. Hereinafter, reference to a "gel" is intended to be any of the gels described in any of these applications. Though the gel is preferably used to fill the casing, it of course is apparent that this is not always necessary and the invention is usable in an unfilled state also. It is also preferred that the gel be included within the casing as shown in FIG. 5.

As stated earlier the cover may have additional structure as shown in FIG. 4. This structure consists of central spaced-apart projections 40 which define first 42 and second 44 fixed-sized passageways. Although not shown, the cover first and second passageways may also have fixed projections or teeth therein. Additionally the casing 12 as shown in FIG. 2 may have a central cavity 46 so that when the cover with the spaced-apart projections 40 is mated with the casing, the central spaced-apart projections 40 enter the central cavity 46 and the cover first 42 and second 44 passageways register respectively with the casing first 18 and second 20 passageways. This additional structure has the advantage of providing additional support and environmental protection for the electrical wires. The cover may further comprise insulation displacement connectors 48 disposed within each of the cover passageways. The insulation displacement connectors 48 are substantially the same as the insulation displacement connectors 70 discussed earlier. These insulation displacement connectors 48 serve to provide electrical contact between electrical wires inserted within the respective passageways.

Figure 7:
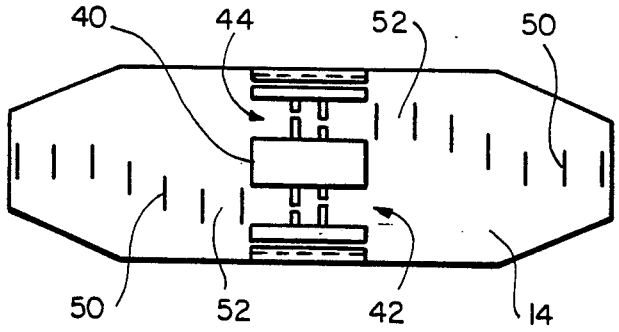
FIG. 7 is a view similar to FIG. 4 illustrating a second embodiment of the cover.

In a second embodiment of the cover as illustrated in FIG. 7, the cover 14 may also have fixed projections or teeth 50 on at least that portion 52 of the cover which overlies the passageways of the casing. The purpose of these projections or teeth is the same as the projections or teeth 22 in the casing, to wit, to provide additional axial strength for the closure to resist pull-out of the wires.

It is possible for the cover to have projections or teeth 50 as shown in FIG. 7 and the casing to have projections or teeth 22 as shown in FIG. 2. However, it is preferred that only the casing have projections or teeth as shown in FIG. 2. These projections or teeth may be on one 54 or 56 but preferably both walls 54, 56 of the passageways as shown in FIG. 2. Additionally or alternatively, the passageways of the casing may have the projections or teeth on the bottom 58 of the passageways. If only the bottom 58 of the passageways contain the projections or teeth, then it is desirable that the cover have the projections or teeth.

Figure 6:
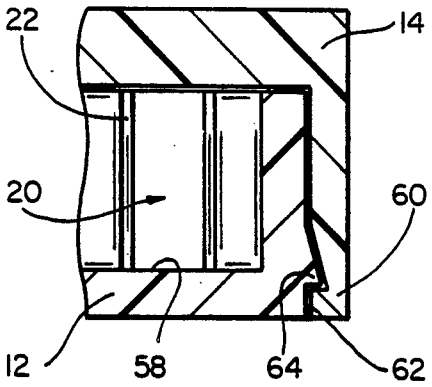
FIG. 6 is an enlarged partial sectional view in the direction of arrows VI—VI as shown in FIG. 1.

Now, the closure may further comprise means for locking the cover and casing in firm engagement. These means may be as simple as screws which connect the cover to the casing. However, screws are not preferred since in the working environment in which the closures are typically used it is undesirable to have small parts such as screws which can easily be misplaced. It is most desirable that the cover be designed so that it be snapped into place. In this regard locking means have been provided wherein the cover may be simply snapped into place over the casing. The operation of the locking means is illustrated in FIG. 6. As can be seen, the cover has a latching portion 60 which snaps into an undercut 62 in the casing and is held there by ledge 64. This design resists the cover being popped off as would ordinarily occur when the wires or cables are pulled upon. As also seen in FIG. 6 there is shown one of the passageways 20 with the longitudinally-dimensioned fixed projections or teeth 22 therein. For clarity the cover shown in FIG. 6 is a flat cover wherein the additional structure as shown in FIGS. 4 and 7 is missing. However, it is of course contemplated within the scope of the invention that a cover may, and usually will, be used that has this additional structure.

Figure 8:
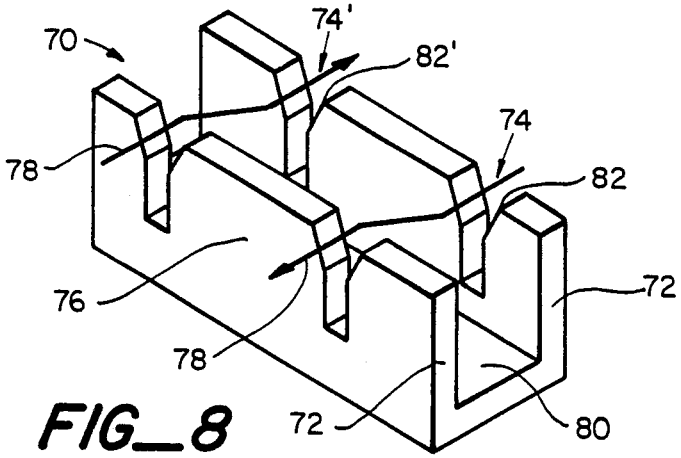
FIG. 8 is an enlarged perspective view of a preferred embodiment of the insulation displacement connector.

Shown in FIG. 8 is an enlarged perspective view of a most preferred embodiment of the insulation displacement connector 70. The connector comprises a pair of spaced-apart walls 72 joined by a connecting wall 80. When viewed in cross-section, the connector would appear U-shaped. Each spaced-apart wall has at least one slot 74 therein for receiving a wire. The slots are laterally offset so that when a wire is placed within the slots, the wire would assume a configuration as schematically indicated by arrow 78. It is most preferred that adjacent insulation displacement connectors 70 be connected by solid portion 76. When so connected, slots 74 are adjacent and connected to slots 74'.

The most preferred insulation displacement connector is configured such that wires may be placed upon adjacent slots 74, 74' and as the wires are pushed down, the teeth 82, 82' of the insulation displacement connector pierce and penetrate the wire insulation so as to make contact with the electrical conductors of the wires. Electrical contact between the respective electrical conductors is maintained through solid portion 76 of the insulation displacement connector.

It is expected that the insulation displacement connector shown in FIG. 8 would be made from a single piece of stamped steel, copper-clad steel, aluminum, beryllium copper or similar material. However, it is within the scope of the invention that the insulation displacement connector may be made in two or more pieces and then joined together during assembly of the closure. In those applications where it is essential to maintain electrical continuity between the wires, it would of course be most desirable for that electrical continuity to occur through solid portion 76. However, it is also within the scope of the invention for electrical continuity to be maintained through a splice, in which case it is not essential for slots 74 and 74' to be electrically and/or physically connected.

Figure 9:
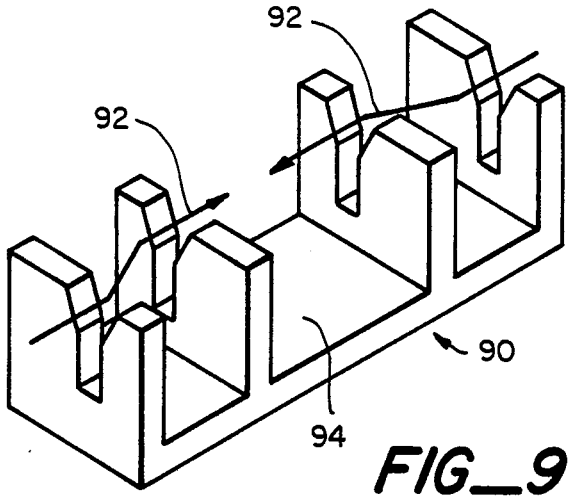
FIG. 9 is an enlarged perspective view of an alternative embodiment of the insulation displacement connector.

FIG. 9 illustrates an alternative embodiment 90 of the insulation displacement connector. This embodiment is especially suited for making butt connections between wires. Thus, all that need be done to form the connection is to place the wires end to end, as schematically illustrated by arrows 92. Splicing of the wires is unnecessary since electrical continuity is maintained through wall 94.

Figure 10:
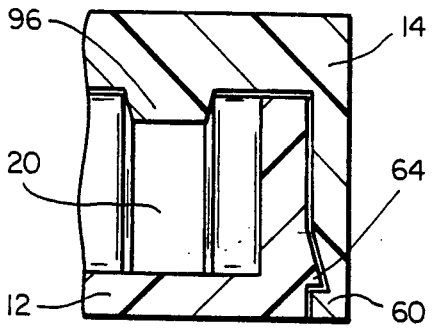
FIG. 10 is a view similar to FIG. 6 showing means on the cover for wedging the wires in the passageways.

Under certain circumstances, it may be desirable to provide a means for assisting in the wedging of the wires in the passageways. Shown in FIG. 10 is such a means for wedging a wire within each of the passageways. The means consists of a boss 96 on that portion of the cover which overlies each of the passageways. As is apparent from FIG. 10, boss 96 dips into each of the passageways. In use, once the wires are placed within the passageways and the cover is placed over the casing, boss 96 wedges the wires down into the passageways. Boss 96 thus aids in the assembling of the wires and closure.

Figure 11:
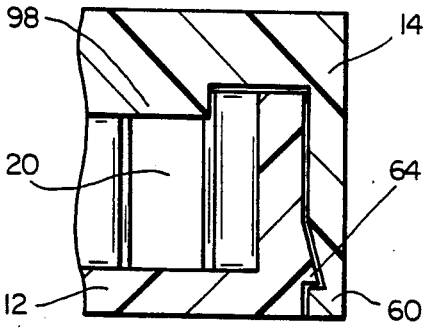
FIG. 11 is another view similar to FIG. 6 showing alternative means on the cover for wedging the wires in the passageways.

FIG. 11 illustrates an alternative embodiment of the wedging means. In this case, the wedging means consists of a single boss 98 which overlies both of the passageways. However, the function of boss 98 remains the same as boss 96 discussed above.

Figure 12:
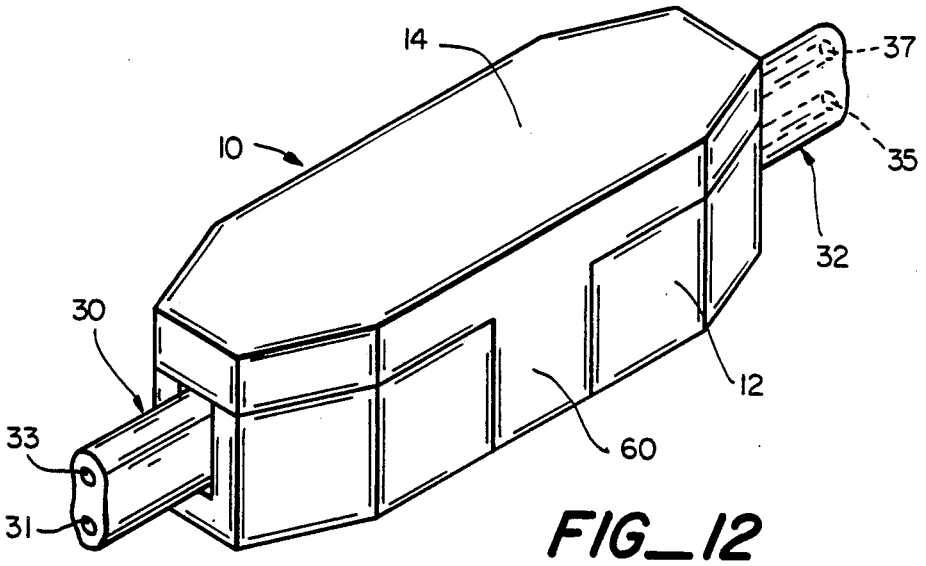
FIG. 12 is a perspective view of a preferred embodiment of the assembled closure.

The preferred embodiment of the assembled closure is illustrated in FIG. 12. In this preferred embodiment, the casing contains insulation displacement connectors 70, as illustrated for example in FIGS. 2 and 5, and the cover contains insulation displacement connectors 48, as illustrated for example in FIGS. 4 and 7. A particular advantage of the preferred embodiment is that the wires 30, 32 may be situated vertically within the closure, instead of laying flat. Thus, bottom conductors 31, 35 may be electrically connected via connectors 70 and top conductors 33, 37 may be electrically connected via connectors 48. This arrangement makes for a very effective and compact closure.

It should be understood that the closures according to the invention are suitable for connecting wires to wires, cables to cables or wires to cables. All the aforementioned applications of the closures according to the invention are thus contemplated to be within the scope of the invention.

The various embodiments described above are particularly suitable as aerial drop wire closures; however they alternatively may be used for buried drop wire connectors and enclosures. Additionally, the closures may have utility for telephone, CATV or power applications.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

I claim:

1. A closure comprising:

a casing including first and second fixed-sized passageways; and an insulation displacement connector disposed within each of the passageways, said connector comprising a pair of spaced-apart walls each having at least one slot therein for receiving a wire wherein the slots in each pair of spaced-apart walls are laterally offset from one another

2. The closure of claim 1, wherein inlets for each of the passageways are on opposite sides of the casing.

3. The closure of claim 1, wherein each of the passageways has a plurality of fixed projections or teeth therein.

4. The closure of claim 1, further comprising a cover which is sized for mating with the casing.

5. The closure of claim 4, wherein the cover has projections or teeth on at least that portion which overlies the passageways.

6. The closure of claim 4, further comprising means for locking the cover and casing in firm engagement.

7. The closure of claim 4, wherein the cover has means for wedging a wire within each of the passageways.

8. The closure of claim 4, further comprising a gel disposed within the casing for repelling water and other environmental contaminants.

9. The closure of claim 4, wherein the casing has a central cavity and the cover has central spaced-apart projections defining first and second passageways so that when the cover is mated with the casing, the central spaced-apart projections enter the central cavity and the cover first and second passageways register with the casing first and second passageways.

10. The closure of claim 9, wherein the cover further comprises an insulation displacement connector disposed within each of the cover passageways, said connector comprising a pair of spaced-apart walls each having at least one slot therein for receiving a wire wherein the slots in each pair of spaced-apart walls are laterally offset from one another.

11. An insulation displacement connector having a pair of spaced-apart walls joined by a connecting wall so as to appear U-shaped when viewed in cross-section, each spaced-apart wall having at least one slot therein for receiving a wire wherein the slots are laterally offset from one another.

* * * * *